United States Patent [19]

Takami

[11] Patent Number: 4,829,195

[45] Date of Patent: May 9, 1989

[54] STARTER

[75] Inventor: Kazuo Takami, Hyogo, Japan

[73] Assignee: Mitsubishi Denki Kabushiki Kaisha, Tokyo, Japan

[21] Appl. No.: 166,717

[22] Filed: Mar. 11, 1988

[30] Foreign Application Priority Data

Mar. 12, 1987 [JP] Japan ..... 62-37724[U]

[51] Int. Cl.[4] ..... F02N 11/02

[52] U.S. Cl. ..... 290/48; 290/38 R

[58] Field of Search ..... 290/38 A, 38 B, 38 R, 290/48

[56] References Cited

U.S. PATENT DOCUMENTS

| | | | |
|---|---|---|---|
| 1,775,467 | 9/1930 | Lansing | 290/38 B |
| 1,782,318 | 11/1930 | Royce | 290/38 A |
| 3,791,685 | 2/1974 | Hammau | 290/48 X |
| 4,613,761 | 9/1986 | Yabunaka | 290/36 R |
| 4,665,320 | 5/1987 | De Bello | 290/48 |
| 4,671,125 | 6/1987 | Yabunaka | 290/48 X |

FOREIGN PATENT DOCUMENTS 62-40274 3/1987 Japan .

*Primary Examiner*—William M. Shoop, Jr.
*Assistant Examiner*—W. E. Duncanson, Jr.
*Attorney, Agent, or Firm*—Wolf, Greenfield & Sacks

[57] ABSTRACT

An overhang type starter is arranged such that a pinion provided at the front end of a driving shaft is provided in a position ahead of a bearing which supports the shaft rotatably. The driving shaft has an annular projection formed thereon at a position close to the pinion, the annular projection being slidably supported by a bearing. Since the driving shaft is supported by the annular projection thereof, when the shaft is advanced to its operative position, it is supported at the same point as in the case when the shaft is in a retracted position, and therefore no change occurs in the amount of overhang of the pinion. Accordingly, deflection of the driving shaft and the rotary output shaft is minimized.

14 Claims, 3 Drawing Sheets

STARTER

BACKGROUND OF THE INVENTION

1. Field of the Invention

The present invention relates to a starter and, more particularly, to a so-called overhang type starter in which a pinion is provided at a portion ahead of a bearing.

2. Description of the Prior Art

A typical conventional starter of the type described above has heretofore been constructed as shown in FIG. 3. In the FIG., the reference numeral 1 denotes a rotary output shaft which is connected to an armature rotary shaft 2 of an electric motor through an epicyclic reduction gear (not shown). Formed in the periphery of the output shaft 1 is a helical spline 3 with which an overrunning clutch 4 is spline-fitted for axial sliding in relation to the output shaft 1. The numeral 5 denotes an outer member of the overrunning clutch 4 the inner surface of which is provided with a spline-fitting portion 5*a* which is in fitting engagement with the helical spline 3. The numeral 6 denotes a clutch inner member which is formed integral with a driving shaft 8 which has a pinion 9 provided on its front end portion. The numeral 7 denotes a roller which is interposed between the outer and inner clutch members 5 and 6. The reference numeral 10 denotes a bearing which is firmly press-fitted into a front bracket 11 serving as a machine frame of the starter and which slidably supports the driving shaft 8. The numeral 12 denotes a pinion stopper which is provided on the front end portion of the output shaft 1, 13 a ring for securing the stopper 12, and 14 sleeve metal members provided between the output shaft 1 and the driving shaft 8. Futher, the reference numeral 15 denotes a lever which is pivotally installed with one end thereof engaged with a plunger 17 of an electromagnetic switch 16 and the other end thereof engaged with the overrunning clutch 4.

The operation of the starter having the above-described arrangement will next be explained.

When a starting switch (not shown) is turned on, the electromagnetic switch 16 is energized and the plunger 17 is thereby magnetically drawn and then the lever 15 pivots counterclockwise, thus causing the overrunning clutch 4 to move forward. In consequence, the driving shaft 8 moves forward to bring the pinion 9 into engagement with a ring gear (not shown) of an internal combustion engine. The output shaft 1 is rotated by the electric motor through the epicyclic reduction gear and the rotation of the output shaft 1 is transmitted through the overrunning clutch 4 to the driving shaft 8, that is, the pinion 9 formed thereon, thereby starting the engine. The forward movement of the driving shaft 8 is restricted by the pinion stopper 12 so that the pinion 9 is prevented from projecting excessively from the front end of the front bracket 11.

The conventional starter having the above-described arrangement suffers, however, from the following problems. Since the driving shaft 8 is supported by the bearing 10, when the shaft 8 is advanced or projected (as can be seen from the lower side of the output shaft 1 in FIG. 3), the point at which the shaft 8 is supported by the bearing 10 shifts rearward relative to the pinion 9, that is, the amount of overhang of the pinion 9 increases, and therefore deflection of the output shaft 1 becomes correspondingly serious. Accordingly, when the pinion 9 is rotating, the bearing 10 and other portions are load-bearing, so that it is difficult to obtain desired characteristics and the durability of the starter is disadvantageously low.

SUMMARY OF THE INVENTION

In view of the above-described problems of the prior art, it is a primary object of the present invention to provide a starter which is so designed that it is possible to obtain the desired characteristics and yet to improve the durability.

The above object is achieved by a starter according to this invention which comprises a rotary output shaft driven by an electric motor, a driving shaft having a distal end portion, the driving shaft being axially slidable in relation to the output shaft and rotatable therewith, a pinion provided at the distal end portion of the driving shaft for rotation therewith in one unit, a slide portion formed on the driving shaft, and a bearing supported by a machine frame for axially slidably supporting the slide portion.

Since the driving shaft is supported at the slide portion thereof, the point at which the driving shaft is supported is not changed even when the shaft is moved from the retracted position to the advanced position, that is, the driving shaft is supported at the same point at all times. Accordingly, deflection of the driving shaft and the rotary output shaft is minimized.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and in which.

DESCRIPTION OF THE PREFERRED EMBODIMENTS

The starter according to the present invention will be described hereinunder in detail with reference to the accompanying drawings.

Figure 1:
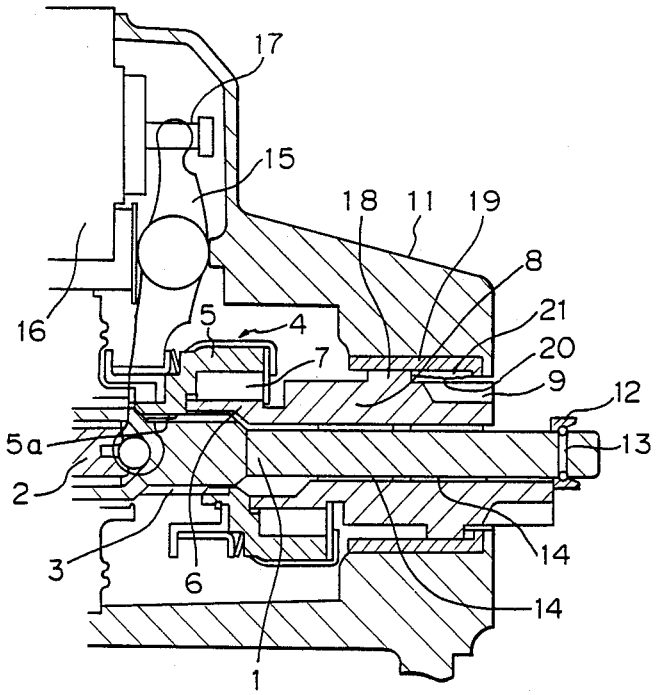
FIG. 1 is a sectional view of one embodiment of the starter according to the present invention.
Figure 3:
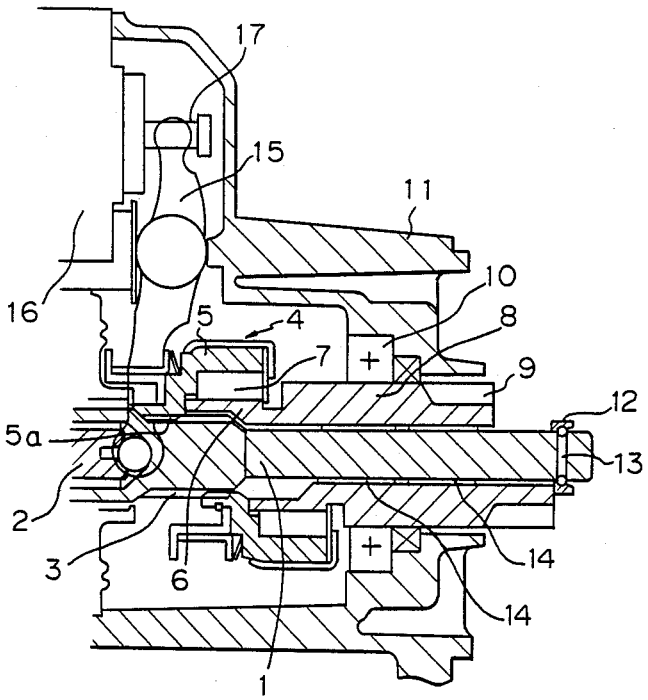
FIG. 3 is a sectional view of a conventional starter.

FIG. 1 is a sectional view of one embodiment of the starter according to the present invention. Since elements in the FIG. which are denoted by the reference numerals 1 to 17 are the same as the corresponding ones of the conventional starter shown in FIG. 3, description thereof is omitted. The reference numeral 18 denotes an annular projection which is formed integral with the driving shaft 8 at a position close to the pinion 9 and which has a cylindrical surface having a predetermined width. The numeral 19 denotes a tubular ceramic bearing which is firmly press-fitted into the front brake 11 and which slidably supports the annular projection 18 by its inner wall. The bearing 19 has a flange slightly extending in the radially inward direction at the front end portion thereof. The numeral 20 denotes a dust-proof rubber member which has one end rigidly secured to the front end portion of the bearing 19 and the other end of which is attached to the annular projection 18 in such a manner that the annular projection 18 is freely rotatable. The space between the rubber member 20 and the bearing 19 defines a grease reservoir 21.

The starter according to this embodiment arranged as detailed above is operated in the same way as the aforementioned conventional starter. More specifically, when the electromagnetic switch 16 is energized, the driving shaft 8 is moved forward by the rotation of the lever 15, and then the driving shaft 8 rotates by virtue of the rotation of the output shaft 1. At this time, since the driving shaft 8 is supported by the annular projection 18 which slides on the inner wall of the bearing 19 while rotating, when the driving shaft 8 is in its advanced position, it is supported at the same point as in the case when the shaft 8 is in its retracted position, so no change occurs in the amount of overhang of the pinion 9. Thus, deflection of the driving shaft 8 and the output shaft 1 is minimized when the starter is in the advanced state, so that the load on the bearing 19 and other portions is reduced.

Although in the above-described embodiment the bearing 19 is rigidly secured to the front bracket 11, the bearing 19 may be rotatably attached to the front bracket 11 through a bearing or the like.

Figure 2:
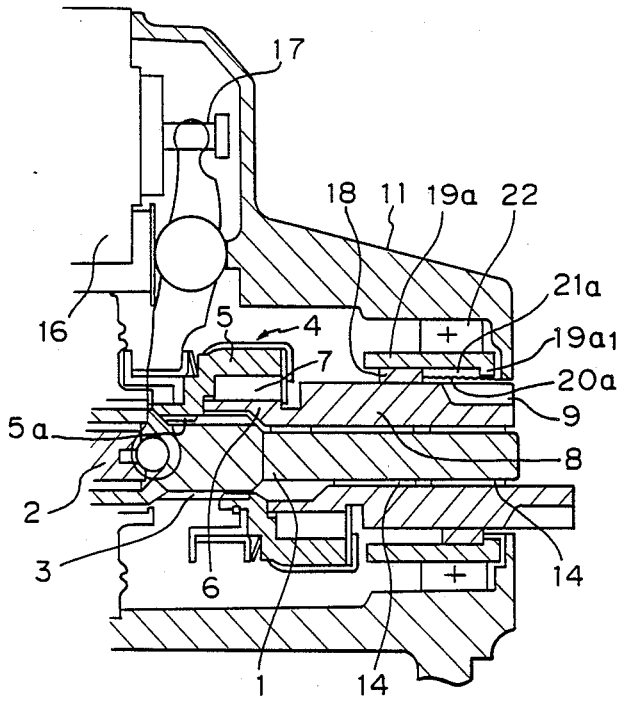
FIG. 2 is a sectional view of another embodiment of the starter according to the present invention.

FIG. 2 shows another embodiment of the present invention in which the bearing for supporting the driving shaft 8 is rotatably mounted and the front end portion of it serves as a pinion stopper. More specifically, the reference numeral 19*a* denotes a ceramic bearing similar to the bearing 19 in the foregoing embodiment. The bearing 19*a* is rotatably supported by the front bracket 11 through a bearing 22. The bearing 19*a* has a flange $19a_1$ extending in the radially inward direction at the front end thereof which defines a pinion stopper structure adapted to prevent pinion 9 from projecting to an excessive extent. The numeral 20*a* denotes a dust-proof rubber member which has one end secured to the front end portion of the front bracket 11 and the other end of it is attached to the annular projection 18 in such a manner that the annular projection 18 is freely rotatable. The space between the rubber member 20*a* and the bearing 19*a* defines a grease reservoir 21*a*. It should be noted that, since the arrangements of the other elements are the same as those in the first embodiment, the corresponding elements are denoted by the same reference numerals and description thereof is omitted.

The starter according to this embodiment arranged as described above is operated in the same way as in the case of the first embodiment. More specifically, when the driving shaft 8 is in its advanced position, the annular projection 18 slides on the inner wall of the bearing 19*a* while rotating. Therefore, no change occurs in the amount of overhang of the pinion 9, and deflection of the driving shaft 8 and the output shaft 1 is minimized when the starter is in an operative state. Further, when the driving shaft 8 is in its advanced position, the front end of the annular projection 18 abuts against the flange $19a_1$ of the bearing 19*a* so as to prevent the pinion 9 from excessively projecting from the front end of the front bracket 11. Accordingly, it is unnecessary to provide the conventional stopper which it has heretofore been necessary to dispose on the front end portion of the output shaft 1 and it is possible to reduce the overall length of the starter.

As has been described above, the present invention provides a starter in which a driving shaft is provided with a slide portion which is slidably supported by a bearing. Accordingly, no change occurs in the amount of overhang of the pinion even when the pinion driving shaft is advanced to its operative position, and therefore deflection of the pinion driving shaft and the output shaft is minimized. Thus, it is advantageously possible to obtain desired characteristics and to improve the durability of the starter.

Although the present invention has been described through specific terms, it should be noted here that the described embodiments are not necessarily exclusive and various changes and modifications may be imparted thereto without departing from the scope of the invention which is limited solely by the appended claims.

What is claimed is:

1. In a starter motor having an electric motor, an output shaft rotated by said electric motor, a hollow cylindrical drive shaft having a pinion gear at one end thereof and an outer periphery, said drive shaft sliding over said output shaft and being rotated thereby, means for sliding said drive shaft over said output shaft for a predetermined distance to engage said pinion gear with an engine flywheel and a supporting bracket surrounding said output shaft and said drive shaft, an improved bearing between said drive shaft and said bracket comprising:

a hollow cylindrical bearing having a length at least equal to said predetermined distance, said cylindrical bearing being mounted within said supporting bracket and said output shaft and said drive shaft passing through said cylindrical bearing; and a bearing ridge located on said outer periphery of said drive shaft, said bearing ridge engaging in sliding and rotating contact with said cylindrical bearing.

2. In a starter motor according to claim 1, the improved bearing wherein said cylindrical bearing is rotatable with respect to said bracket.

3. In a starter motor according to claim 1 wherein said cylindrical bearing has a proximal end against which said ridge rests when said drive shaft is not engaged with said flywheel and a distal end against which said ridge rests when said drive shaft is engaged with said flywheel and wherein said distal end of said cylindrical bearing comprises a flange extending radially towards said output shaft to form a stop which said ridge engages when said drive shaft moves toward said flywheel in order to limit the travel of said drive shaft towards said flywheel.

4. In a starter motor according to claim 1 further comprising a flexible boot having one end secured to said bracket and another end secured to said ridge in order to form a grease pocket between said flexible boot and said cylindrical bearing.

5. A starter motor comprising:

an electric motor;

an output shaft rotated by said electric motor;

a hollow cylindrical drive shaft having a pinion gear at one end thereof and an outer periphery, said drive shaft sliding over said output shaft and being rotated thereby;

means for sliding said drive shaft over said output shaft for a predetermined distance to engage said pinion gear with an engine flywheel;

a supporting bracket surrounding said output shaft and said drive shaft;

a hollow cylindrical bearing having an inner surface and an outer surface and a length at least equal to said predetermined distance, said cylindrical bearing being mounted within said supporting bracket and said output shaft and said drive shaft passing through said cylindrical bearing; and a bearing ridge located on said outer periphery of said drive shaft, said bearing ridge engaging in sliding and rotating contact with said inner surface of said cylindrical bearing.

6. A starter motor according to claim 5 wherein a second bearing is provided between said outer surface of said cylindrical bearing and said bracket so that said cylindrical bearing is rotatable with respect to said bracket.

7. A starter motor according to claim 5 wherein said cylindrical bearing has a proximal end against which said ridge rests when said drive shaft is not engaged with said flywheel and a distal end against which said ridge rests when said drive shaft is engaged with said flywheel and wherein said distal end of said cylindrical bearing comprises a flange extending radially towards said output shaft to form a stop which said ridge engages when said drive shaft moves toward said flywheel in order to limit the travel of said drive shaft towards said flywheel.

8. A starter motor according to claim 5 further comprising a flexible boot having one end secured to said bracket and another end secured to said ridge in order to form a grease pocket between said flexible boot and said inner surface of said cylindrical bearing.

9. A electric starter motor for starting an engine having a toothed flywheel, said starter motor comprising:

an electric motor;

a cylindrical output shaft rotated by said electric motor;

a hollow cylindrical drive shaft having a pinion gear at one end thereof and an outer periphery, said drive shaft sliding over said output shaft, a clutch mechanism connecting said output shaft and said drive shaft, so that said drive shaft is rotated by said output shaft;

a solenoid and shift arm connected to said clutch mechanism for sliding said drive shaft over said output shaft for a predetermined distance to engage said pinion gear with said flywheel;

a motor case surrounding said motor, said output shaft, said drive shaft and said clutch mechanism, said motor case having a supporting bracket surrounding said output shaft and said drive shaft;

a hollow cylindrical bearing having an inner surface and an outer surface and a length at least equal to said predetermined distance, said cylindrical bearing being mounted within said supporting bracket and said output shaft and said drive shaft passing through said cylindrical bearing; and a bearing ridge located on said outer periphery of said drive shaft, said bearing ridge engaging in sliding and rotating contact with said inner surface of said cylindrical bearing.

10. A starter motor according to claim 9 wherein a second bearing is provided between said outer surface of said cylindrical bearing and said bracket so that said cylindrical bearing is rotatable with respect to said bracket.

11. A starter motor according to claim 10 wherein said cylindrical bearing is comprised of a ceramic material.

12. A starter motor according to claim 11 wherein said cylindrical bearing has a proximal end against which said ridge rests when said drive shaft is not engaged with said flywheel and a distal end against which said ridge rests when said drive shaft is engaged with said flywheel and wherein said distal end of said cylindrical bearing comprises a flange extending radially towards said output shaft to form a stop which said ridge engages when said drive shaft moves toward said flywheel in order to limit the travel of said drive shaft towards said flywheel.

13. A starter motor according to claim 11 wherein said output shaft has a snap ring which limits travel of said drive shaft towards said flywheel.

14. A starter motor according to claim 11 further comprising a rubber boot having one end secured to said bracket and another end secured to said ridge in order to form a grease pocket between said rubber boot and said inner surface of said cylindrical bearing.

* * * * *